US010704868B1

(12) United States Patent
Kirkbride

(10) Patent No.: US 10,704,868 B1
(45) Date of Patent: Jul. 7, 2020

(54) NON-PYROTECHNIC FLARE SYSTEMS AND METHODS

(71) Applicant: THE BOEING COMPANY, Chicago, IL (US)

(72) Inventor: David William Kirkbride, Mukilteo, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/423,679

(22) Filed: May 28, 2019

(51) Int. Cl.

| | |
|---|---|
| ***F42B 4/26*** | (2006.01) |
| ***F21S 10/06*** | (2006.01) |
| ***F21V 15/01*** | (2006.01) |
| *F21W 111/00* | (2006.01) |
| *F21Y 115/10* | (2016.01) |

(52) U.S. Cl.
CPC ..... *F42B 4/26* (2013.01); *F21S 10/066* (2013.01); *F21V 15/01* (2013.01); *F21W 2111/00* (2013.01); *F21Y 2115/10* (2016.08)

(58) Field of Classification Search
CPC ..... F42B 4/26; F42B 4/28; F42B 4/04; F42B 12/42; F42B 12/48; F42B 12/365; F42B 8/28; F21S 10/066; F21V 15/01
USPC ... 340/815.4, 815.45, 815.5, 815.57, 815.66, 340/815.68; 382/155, 183, 190
See application file for complete search history.

(56) References Cited

U.S. PATENT DOCUMENTS

| | | | | |
|---|---|---|---|---|
| 5,386,781 A * | 2/1995 | Day | F42B 4/28 102/337 |
| 5,610,364 A * | 3/1997 | Endicott, Jr. | F42B 4/26 102/334 |
| 10,591,266 B2 * | 3/2020 | Berseneff | F42B 12/365 |
| 2015/0266792 A1 * | 9/2015 | Nielson | F42B 4/28 149/21 |

* cited by examiner

*Primary Examiner* — Hung T Nguyen
(74) *Attorney, Agent, or Firm* — The Small Patent Law Group LLC; Joseph M. Butscher

(57) ABSTRACT

A non-pyrotechnic flare system and method includes at least one flare member that is configured to be deployed. The flare member(s) includes a head having a light-emitting diode (LED) that is configured to emit light when activated, and a wing-shaped appendage extending from the head. In at least one embodiment, a casing retains the flare member(s) in a stowed position. The flare member(s) is configured to be deployed from the casing.

20 Claims, 6 Drawing Sheets

NON-PYROTECHNIC FLARE SYSTEMS AND METHODS

FIELD OF EMBODIMENTS OF THE DISCLOSURE

Embodiments of the present disclosure generally relate to non-pyrotechnic flare systems and methods, which are safer to use than traditional flares.

BACKGROUND OF THE DISCLOSURE

A flare is a pyrotechnic device that produces light and heat when activated. Flares are used for distress signaling, illumination, defensive countermeasures and/or the like. An individual may fire a flare from a handheld flare gun. As another example, flares may be fired from artillery, dropped from aircraft, or the like.

A typical flare generates heat when activated. As can be appreciated, flares present fire hazards in that they are typically formed from flammable and/or combustible materials. Moreover, as a flare descends onto ground, the ignited flare may pose a fire risk to objects or structures on the ground (such as trees, dwellings, etc.), which may catch fire upon contact with the ignited flare. In general, known flares are volatile and pose fire hazards when stored and activated.

SUMMARY OF THE DISCLOSURE

A need exists for a safer flare. Further, a need exists for a flare that is non-flammable. Moreover, a need exists for a flare that is not susceptible to igniting structures or objects upon contact therewith.

With those needs in mind, certain embodiments of the present disclosure provide a non-pyrotechnic flare system that includes at least one flare member that is configured to be deployed. The flare member(s) includes a head having a light-emitting diode (LED) that is configured to emit light when activated, and a wing-shaped appendage extending from the head. The wing-shaped appendage is configured to control a descent of the flare member(s).

In at least one embodiment, a casing retains the flare member(s) (such as a plurality of flare members) in a stowed position. The flare member(s) is configured to be deployed from the casing. A charging circuit may be coupled to one or both of the casing or the LED.

In at least one embodiment, the wing-shaped appendage includes a root that radially extends from the head. The root includes an interior cuff. An intermediate beam is connected to the interior cuff. An expanded distal end is connected to the intermediate beam. The wing-shaped appendage is aerodynamically shaped to allow the at least one flare member to rotate and descend towards ground at a controlled speed when the flare member(s) is deployed.

The flare member(s) may be formed of one or more biodegradable materials.

At least a portion of the wing-shaped appendage may include a reflective material that is configured to reflectively disperse light emitted by the LED.

The LED may be configured to emit the light at an ultraviolet (UV) wavelength at 100 cycles per minute.

In at least one embodiment, the wing-shaped appendage is moveable between a stowed position, in which the wing-shaped appendage is coiled around the head, and an extended deployed position. The wing-shaped appendage may be formed of a piezoelectric material, and the LED may be powered by the wing-shaped appendance moving from the stowed position to the extended deployed position.

Certain embodiments of the present disclosure provide a non-pyrotechnic flare method including deploying at least one flare member, emitting light, during the deploying, from a light-emitting diode (LED) of a head, and controlling a descent of the flare member(s), during the deploying, with a wing-shaped appendage extending from the head.

In at least one embodiment, the non-pyrotechnic flare method also includes retaining the flare member(s) in a stowed position within the casing. The deploying may include deploying the flare member(s) from the casing.

The non-pyrotechnic flare method may include coupling a charging circuit to one or both of the casing or the LED.

In at least one embodiment, the non-pyrotechnic flare method also includes shaping the wing-shaped appendage to allow the flare member(s) to rotate and descend towards ground at a controlled speed during the deploying.

The non-pyrotechnic flare method may also include forming the flare member(s) from one or more biodegradable materials. The non-pyrotechnic flare method may also include providing at least a portion of the wing-shaped appendage with a reflective material.

In at least one embodiment, the emitting includes emitting the light at an ultraviolet (UV) wavelength at 100 cycles per minute.

In at least one embodiment, the non-pyrotechnic flare method also includes moving the wing-shaped appendage between a stowed position, in which the wing-shaped appendage is coiled around the head, and an extended deployed position, and powering the LED by the moving.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps.

Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide a non-pyrotechnic flare system that includes a flare casing that holds a plurality of deployable flare members. Each deployable flare member includes a head including a light-emitting diode (LED). In at least one embodiment, the head includes a power source connectable to the LED. In at least one other embodiment, the power source is remote from the head and connectable to the LED. The flare member also includes a wing-shaped appendage depending from the head. In at least one embodiment, the wing-shaped appendage is formed of or otherwise includes a light-reflective material. In at least one embodiment, the wing-shaped appendage is configured to transition between a collapsed stowed position, and an uncoiled deployed position in which the wing-shaped appendage causes autorotation of the flare member during free-fall after a launch or other such deployment of the non-pyrotechnic flare system. In at least one embodiment, the wing-shaped appendage includes light-reflective material that is configured to reflectively disperse light emitted by the LED. In at least one embodiment, the LED is configured to be powered by the power source upon transition of the wing-shaped appendage to the deployed position, such that the light-reflective material is configured to reflectively disperse light emitted by the LED only after deployment of the wing-shaped appendage.

Figure 1:
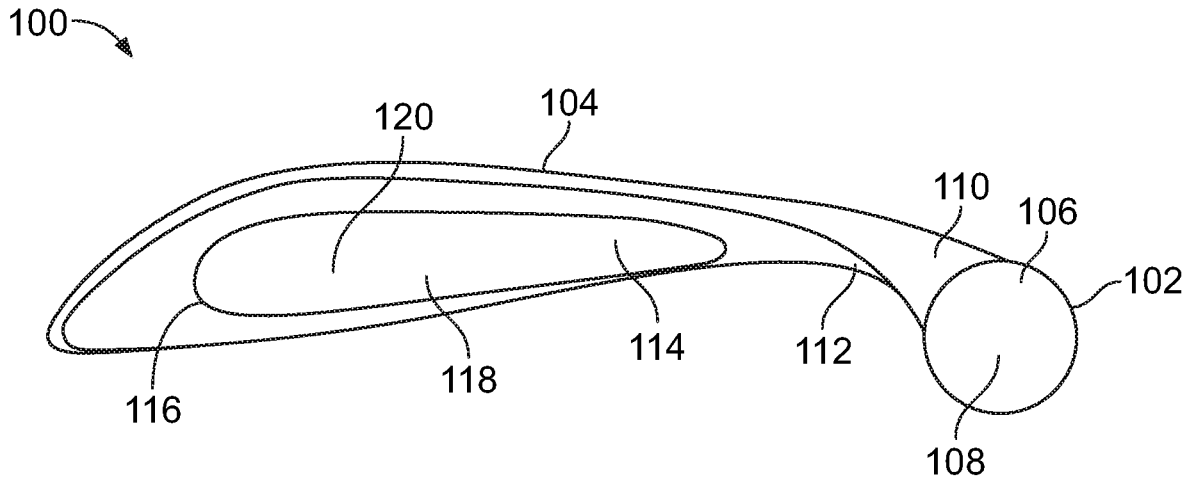
FIG. 1 illustrates a front view of a flare member, according to an embodiment of the present disclosure.

FIG. 1 illustrates a front view of a flare member 100, according to an embodiment of the present disclosure. The flare member 100 is configured to be deployed from a flare casing. The flare member 100 includes a head 102 coupled to a wing-shaped appendage 104, which may be sized and shaped similar to a feather. The wing-shaped appendage 104 depends from the head 102. The head 102 includes a housing 106 that retains a light-emitting diode (LED) 108 that is configured to emit light when the LED 108 is activated.

The wing-shaped appendage 104 includes a root 110 that radially extends from the head 102. The root 110 includes an interior cuff 112 that connects to an intermediate beam 114, which, in turn, connects to an expanded distal end 116. The wing-shaped appendage 104 is aerodynamically shaped to allow the flare member 100 to rotate and descend towards ground at a controlled speed when the flare member 100 is deployed. For example, the flare member 100 including the wing-shaped appendage 104 and the head 102 is sized and shaped similar to a maple seed.

In at least one embodiment, the flare member 100 is formed of one or more biodegradable materials. For example, the housing 106 and the wing-shaped appendage 104 may be formed of one or more of biodegradable paper, cardboard, organic (such as plant-based) materials, and/or the like. In this manner, the biodegradable materials leave little to no waste after use. In at least one other embodiment, the flare member 100 may be formed of one or more polymers, such as polyurethane.

In at least one embodiment, at least a portion of the wing-shaped appendage 104 is formed of and/or coated with a reflective material, such as reflective paper, one or more mirrored surfaces, and/or the like. For example, an interior surface 118 of the wing-shaped appendage 104 may be formed of, or coated with, a reflective material 120, that is configured to reflect light emitted by the LED 108. Optionally, the wing-shaped appendage 104 may not include a reflective material.

The LED 108 is configured to emit light at a desired wavelength. In at least one embodiment, the LED 108 is configured to emit visible light, such as red, orange, yellow, green, blue, indigo, or violet light. In at least one embodiment, the LED 108 may be configured to alternately emit light at different wavelengths. For example, the LED 108 may be configured to cycle among emitted light at different wavelengths over a time period.

In at least one embodiment, the LED 108 is configured to emit light at an ultraviolet (UV) wavelength. The UV light may be emitted at 100 cycles per minute. It has been found that UV light emitted at 100 cycles per minute is particularly useful in repelling birds. As such, the flare member 100 emitting such light is particularly useful with respect to deterring wildlife, such as birds, at and/or proximate to an airport runway, thereby reducing a potential of such wildlife contacting aircraft that are taking off from and landing on the airport runway.

Figure 2:
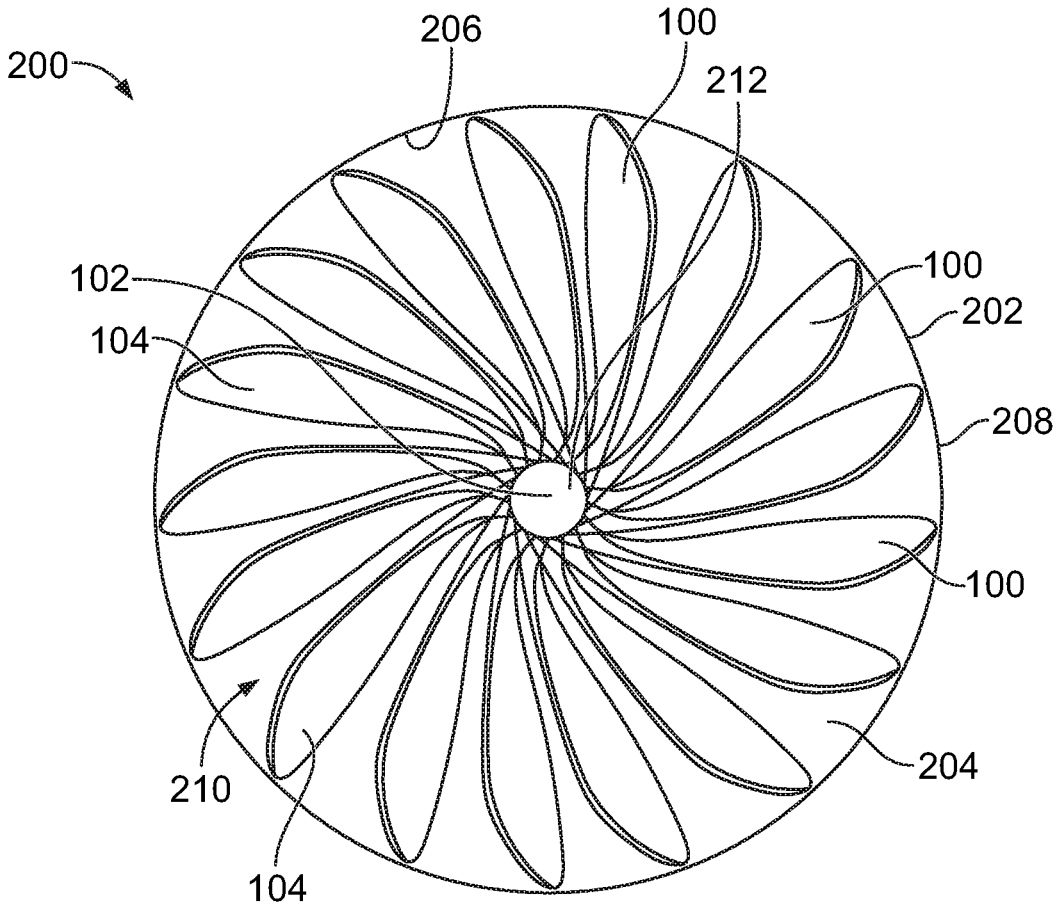
FIG. 2 illustrates a top view of a non-pyrotechnic flare system, according to an embodiment of the present disclosure.

FIG. 2 illustrates a top view of a non-pyrotechnic flare system 200, according to an embodiment of the present disclosure. The non-pyrotechnic flare system 200 includes a casing 202 having a base 204 connected to a cover 206 by an outer wall 208, such as a circumferential wall. An internal retaining chamber 210 is defined between the base 204, the cover, and the outer wall 208.

A plurality of flare members 100 are retained within the internal retaining chamber 210. As shown, the heads 102 of the flare members 100 may be centrally positioned proximate a center 212 of the casing 202. The heads 102 may overlie one another at the center 212. The wing-shaped appendages 104 radially extend from the center 212 towards inner surfaces of the outer wall 208.

Figure 3:
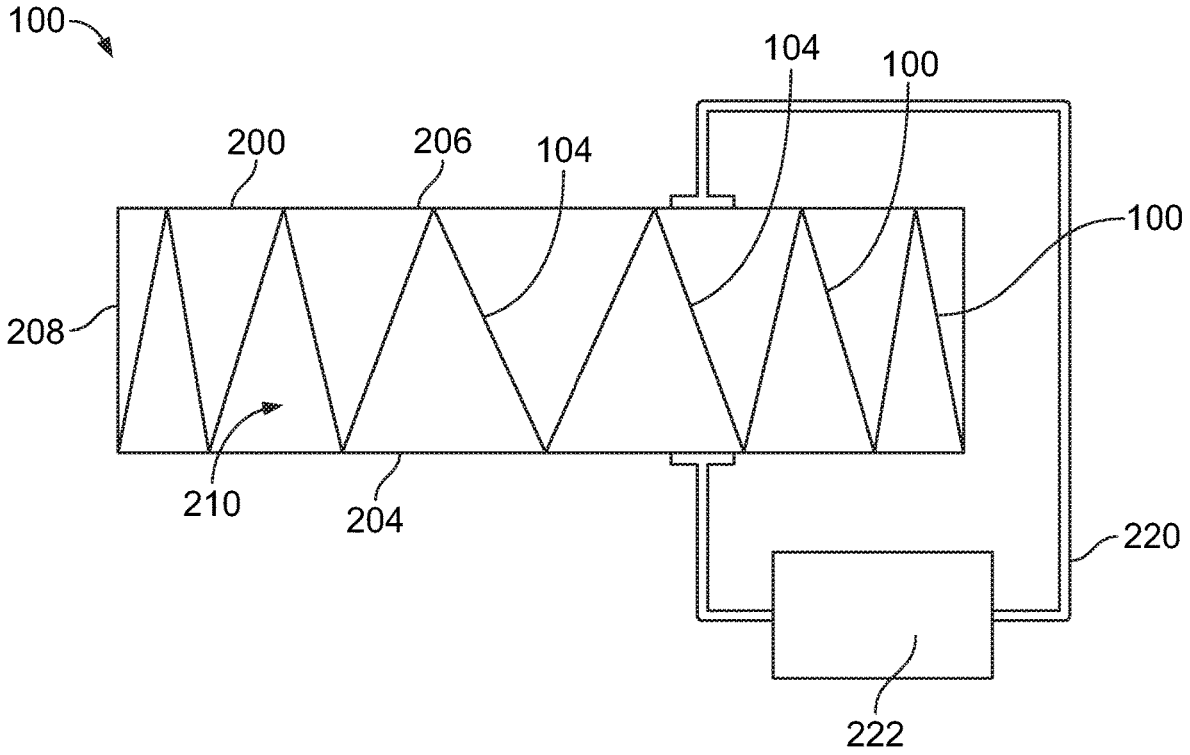
FIG. 3 illustrates a lateral view of the non-pyrotechnic flare system of FIG. 2.

FIG. 3 illustrates a lateral view of the non-pyrotechnic flare system 200 of FIG. 2. As shown in FIGS. 2 and 3, the flare members 100 are in stowed positions within the casing 202. A charging circuit 220 is coupled to the casing 202 and/or the LEDs 108 of the flare members 100. The charging circuit 220 includes a battery 222 that is configured to charge the LEDs 108, such as via one or more capacitors. In at least one embodiment, the battery 222 is external to the LEDs 108. In at least one other embodiment, the flare members 100 each include a battery that is charged by the charging circuit 220.

The charging circuit 220 is configured to charge the LEDs 108 to emit light when the flare members 100 are deployed from the casing 202. The charging circuit 220 is configured to charge the LEDs 108 to emit light for a predefined period of time, such as 5-15 seconds, when the flare members 100 deploy from the casing 202.

In operation, the non-pyrotechnic flare system 200 is deployed, such as via being shot from a gun, launched from a cannon, dropped from an aircraft, and/or the like. In at least one embodiment, the casing 202 is configured to open at a predetermined time, altitude, or the like after being deployed. For example, the casing 202 may include one or more springs that activate at a predetermined time to open the casing 202. In at least one other embodiment, the casing 202 may disintegrate due to air friction. In at least one other embodiment, the casing 202 may open due to a change in air pressure.

As the casing 202 opens, the flare members 100 deploy from the casing 202. In at least one embodiment, the charging circuit 220 and/or the LEDs 108 include one or more switches that activate the LEDs 108 to emit light as the flare members 100 deploy from the casing 202.

The aerodynamic wing-shaped appendages 104 control the descent of the flare members 100 to the ground. As the flare members 100 are deployed and in flight, the light emitted by the LEDs 108 is visible. Further, the reflective materials 120 of the wing-shaped appendages 104 reflect the emitted light from the LEDs 108. As such, the flare members 100 generate light without generating heat, or posing a fire hazard. Instead, the flare members 100 provide non-pyrotechnic light that may be used as a signal flare, an emergency signal, a decoy (for example, a jamming decoy cloud cover that is deployed from an aircraft), a deterrent to wildlife (such as at airports), a non-pyrotechnic firework display, and/or the like.

Figure 4:
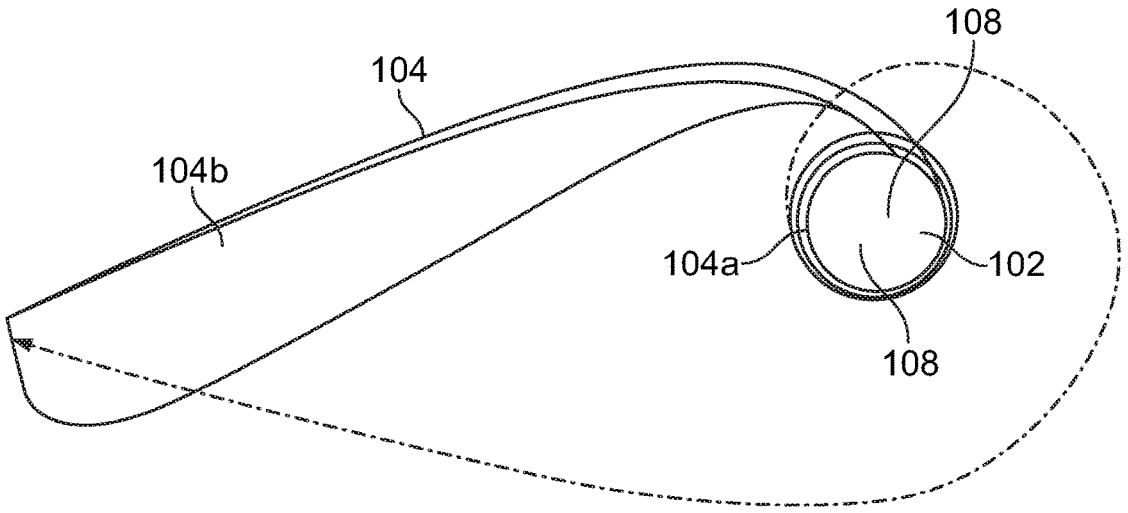
FIG. 4 illustrates a front view of the flare member, according to embodiment of the present disclosure.

FIG. 4 illustrates a front view of the flare member 100, according to embodiment of the present disclosure. In this embodiment, the wing-shaped appendage 104 is formed of a flexible material, such as a flexible biodegradable material, which may include an internal spring. In at least one embodiment, the wing-shaped appendage is formed of a flexible piezoelectric material. In at least one embodiment, the wing-shaped appendage 104 is further configured as described above with respect to FIG. 1.

The wing-shaped appendage 104 is coiled around the head 102 in a stowed position 104*a*. As the flare member 100 releases from a casing, the wing-shaped appendage 104 uncoils towards an extended deployed position 104*b*. During such uncoiling, the piezoelectric material charges an internal capacitor within the head 102. The energy stored by the internal capacitor is then used by the LED 108 to emit light. Therefore, in this embodiment, the flare member 100 need not be charged by a separate charging circuit, but instead independently provides energy for the LED 108 due to the uncoiling of the piezoelectric wing-shaped appendage 104.

Figure 5:
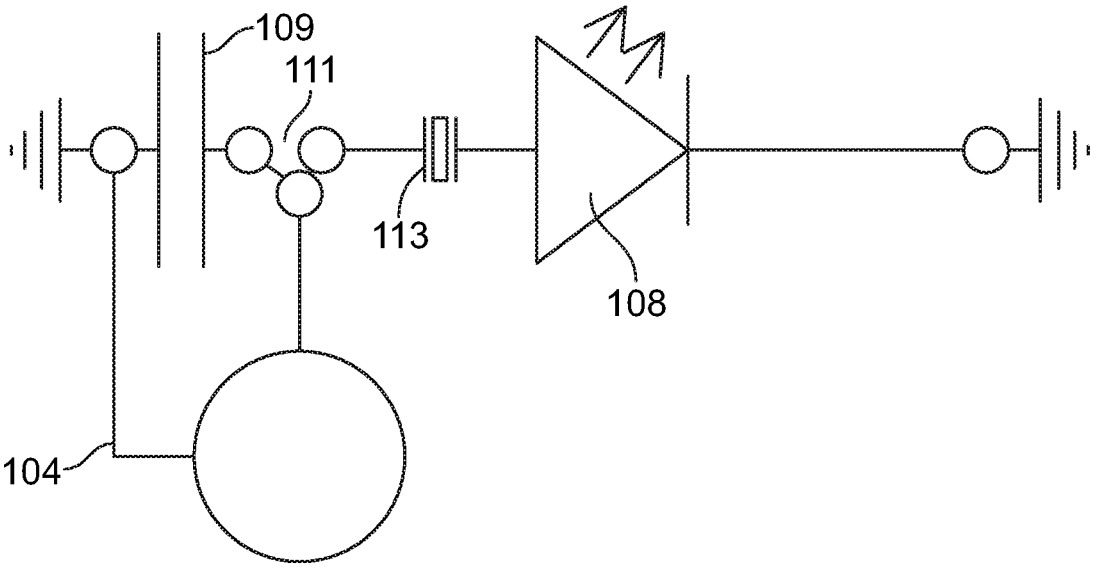
FIG. 5 illustrates a circuit diagram of the flare member of FIG. 4, according to an embodiment of the present disclosure.

FIG. 5 illustrates a circuit diagram of the flare member 100 of FIG. 4, according to an embodiment of the present disclosure. As shown, the piezoelectric wing-shaped appendage 104 is coupled to a switch 111 that is connected to a capacitor 109. As the wing-shaped appendage 104 uncoils, the motion of the wing-shaped member 104 closes the switch 111 and charges the capacitor 109. The resultant energy stored in the capacitor is then used by the LED 108 to emit light.

Optionally, the flare member 100 may include an electrical oscillator 113, which may be used to allow the LED 108 to emit light at a tailored, flashing frequency. A combination of spectrum and oscillation of light emission allows for customization of a flare signature for visual displays, signaling, decoys, jamming signals, dispersing wildlife, and the like.

Figure 6:
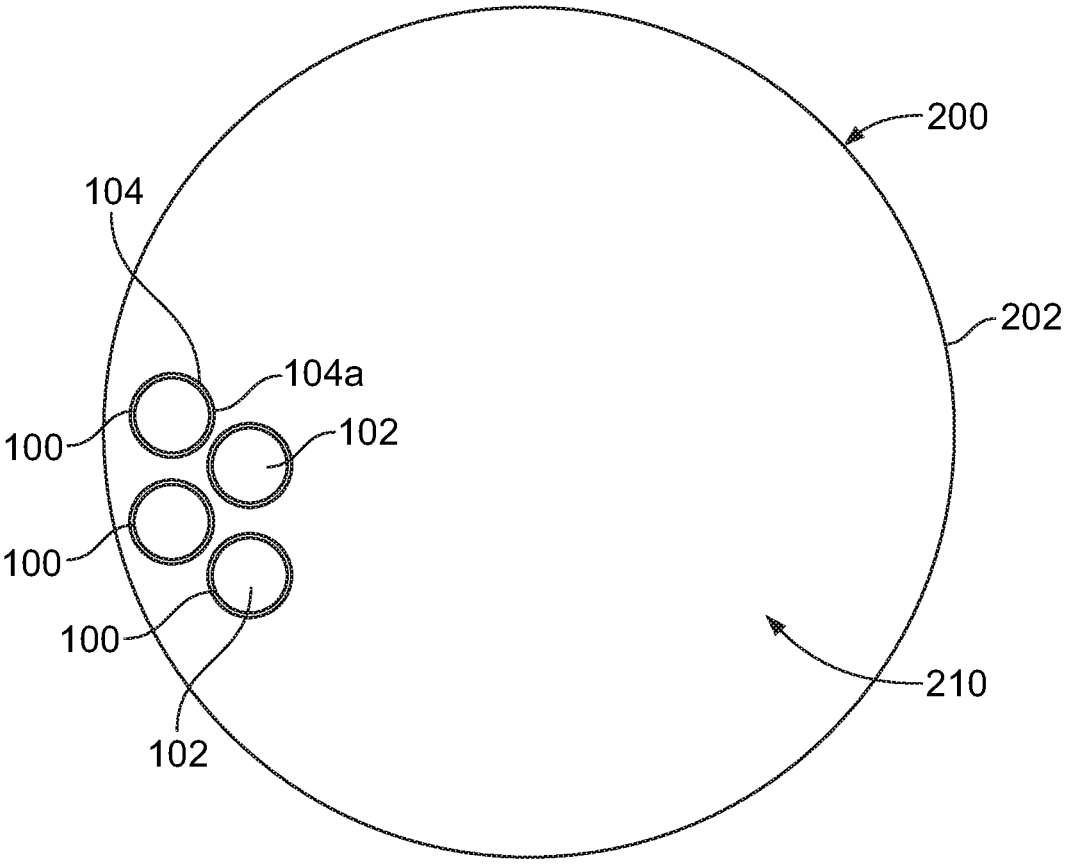
FIG. 6 illustrates a top view of the non-pyrotechnic flare system, according to an embodiment of the present disclosure.

FIG. 6 illustrates a top view of the non-pyrotechnic flare system 200, according to an embodiment of the present disclosure. As shown, the flare members 100 are tightly packed within the internal retaining chamber 210 because the flexible, piezoelectric wing-shaped appendages 104 are tightly wound around the heads 102 in the stowed positions 104*a*.

In operation, as the non-pyrotechnic flare system 200 is deployed and the casing 202 opens, as described above, the flare members 100 deploy from the opened casing 202. As the flare members 100 deploy from the casings 200, the flare members 100 spread apart from one another, thereby allowing the coiled piezoelectric wing-shaped appendages 104 to uncoil from the stowed positions 104*a* to the extended deployed positions 104*b* (shown in FIG. 4), thereby charging the capacitors 109 (shown in FIG. 5) of the flare members 100 and illuminating the LEDs 108. Thus, the wing-shaped appendage 104, which may be formed of a piezoelectric material, is configured to transition between the collapsed, stowed position 104*a*, and the uncoiled, extended deployed position 104*b*. In the extended deployed position 104*b*, the wing-shaped appendage 104 causes autorotation of the flare member 100 during free-fall after a launch or other such deployment of the non-pyrotechnic flare system 200.

In at least one embodiment, the wing-shaped appendage 104 includes light-reflective material, such as the reflective material 120 (shown in FIG. 1) that reflectively disperses light emitted by the LED 108. The LED 108 is activated upon the wing-shaped appendage 104 transitioning from the stowed position 104*a* to the deployed position 104*b*. As such, in at least one embodiment, the reflective material 120 may be configured to reflectively disperse light emitted by the LED 108 only after the wing-shaped appendage 104 transitions to the deployed position 104*b*.

Figure 7:
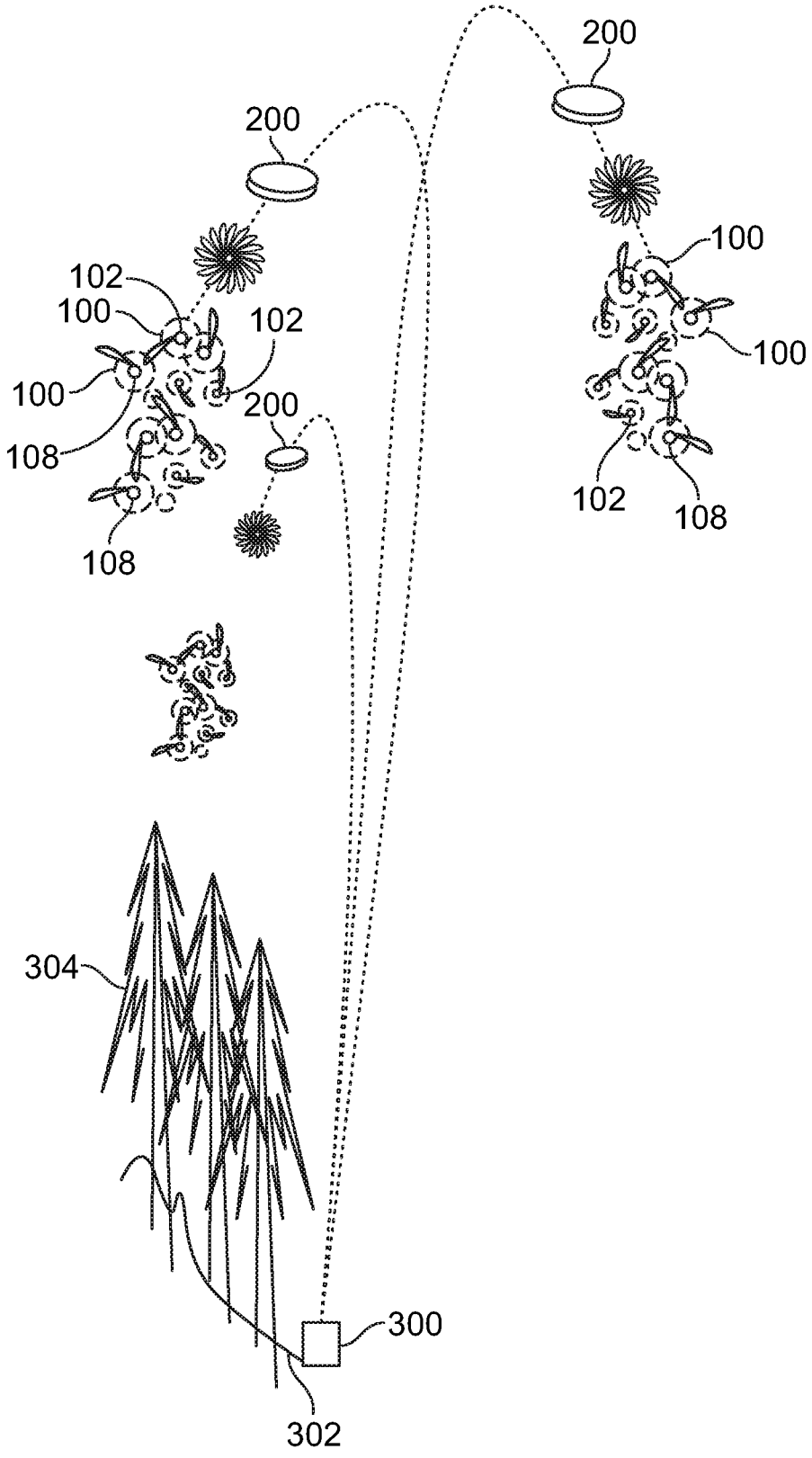
FIG. 7 illustrates a lateral view of non-pyrotechnic flare systems deployed from a deployment device, according to an embodiment of the present disclosure.

FIG. 7 illustrates a lateral view of non-pyrotechnic flare systems 100 (such as any of those described above) deployed from a deployment device 300, according to an embodiment of the present disclosure. The deployment device 300 may deploy (for example, launch) the non-pyrotechnic systems 100 from the ground 302. Optionally, the deployment device 300 may be onboard a vehicle, such as an aircraft. The deployment device 300 may be a hand-held gun, a skeet gun, a slingshot, a cannon, a launch system, or the like. In at least one other embodiment, the deployment device 300 may be an ordnance bay aboard an aircraft.

As the casings 200 open, the flare members 100 deploy therefrom, and emit light, as described herein. Because the light is emitted from LEDs 108 of the heads 102, there is no risk of fire to objects 304, such as trees, on the ground 302 as the flare members 100 descend towards the ground 302.

In at least one embodiment, the deployment device 300 may be proximate to an airport runway. The deployment device 300 may deploy the non-pyrotechnic flare systems 200 to deter wildlife from the airport runway, thereby reducing a potential of wildlife engaging aircraft.

Figure 8:
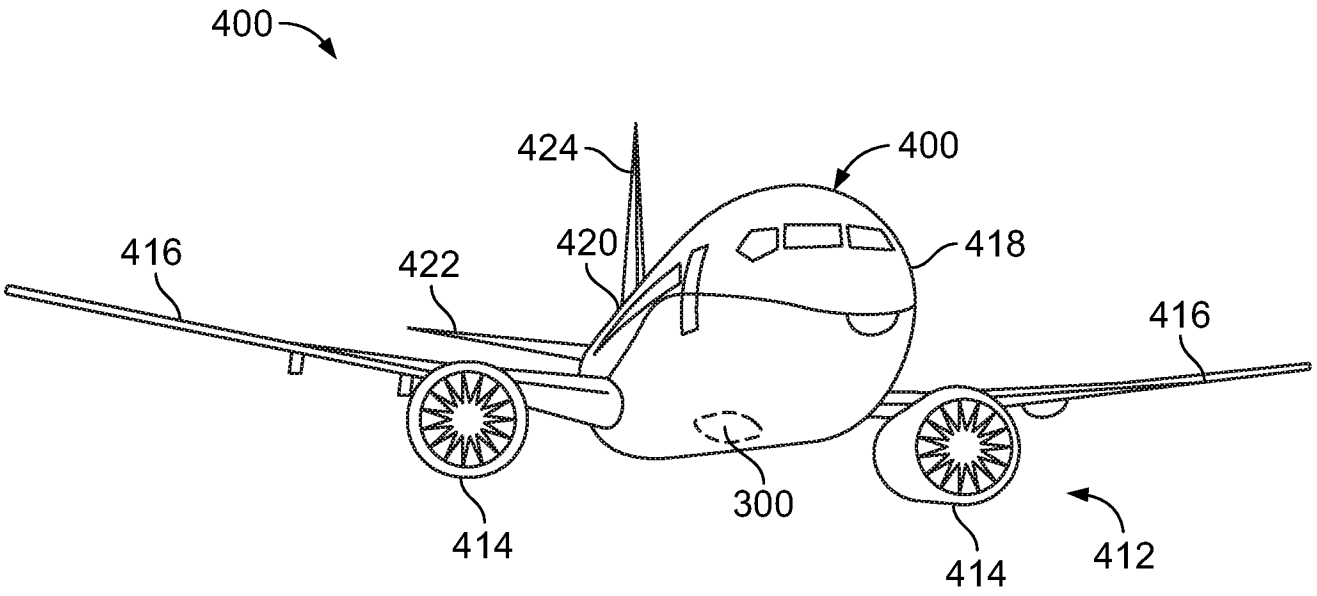
FIG. 8 illustrates a perspective front view of an aircraft, according to an embodiment of the present disclosure.

FIG. 8 illustrates a perspective top view of an aircraft 400, according to an embodiment of the present disclosure. In this embodiment, the aircraft 400 is a commercial jet that includes a propulsion system 412 that includes two turbofan engines 414, for example, which may be powered through jet fuel and/or through electrical power (such as from batteries). Optionally, the propulsion system 412 may include more engines 414 than shown. The engines 414 are carried by wings 416 of the aircraft 104. In other embodiments, the engines 414 may be carried by a fuselage 418 and/or an empennage 420. The empennage 420 may also support horizontal stabilizers 422 and a vertical stabilizer 424.

As shown, the aircraft 400 may include the deployment device 300. For example, the deployment device 300 may be a bay that may be opened. In at least one other embodiment, the deployment device 300 may be or include a launch tube.

FIG. 8 illustrates but one example of an aircraft 400. The aircraft 400 may be sized, shaped, and configured other than shown. In at least one other embodiment, the aircraft 400 may be a military jet. In at least one other embodiment, the aircraft 400 may be an unmanned aerial vehicle (UAV), or drone.

Figure 9:
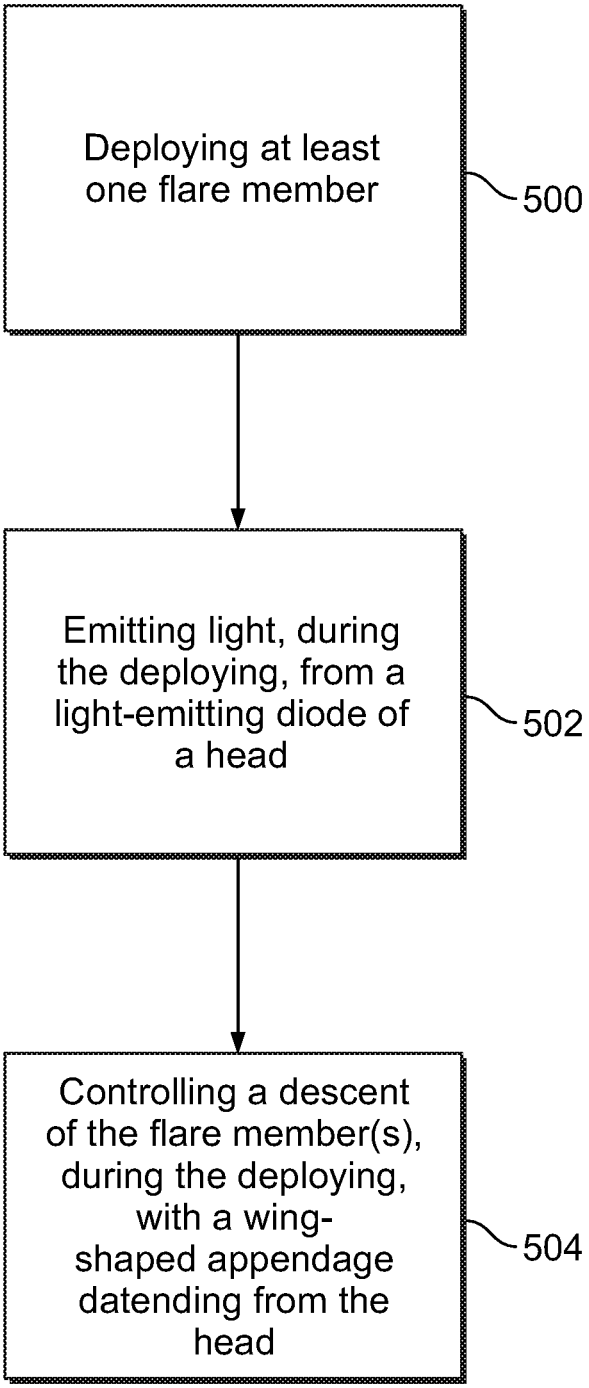
FIG. 9 illustrates a flow chart of a non-pyrotechnic flare method, according to an embodiment of the present disclosure.

FIG. 9 illustrates a flow chart of a non-pyrotechnic flare method, according to an embodiment of the present disclosure. Referring to FIGS. 1-9, the non-pyrotechnic flare method includes deploying (500) at least one flare member

100, emitting (502) light, during the deploying (500), from a light-emitting diode (LED) 108 of a head 102, and controlling (504) a descent of the flare member(s) 100, during the deploying (500), with a wing-shaped appendage 104 extending from the head 102.

In at least one embodiment, the non-pyrotechnic flare method also includes retaining the flare member(s) 100 in a stowed position within the casing 202. The deploying (500) may include deploying the flare member(s) 100 from the casing 202.

The non-pyrotechnic flare method may include coupling a charging circuit 200 to one or both of the casing 202 or the LED 108.

In at least one embodiment, the non-pyrotechnic flare method also includes shaping the wing-shaped appendage 104 to allow the flare member(s) 100 to rotate and descend towards ground at a controlled speed during the deploying (500).

The non-pyrotechnic flare method may also include forming the flare member(s) 100 from one or more biodegradable materials. The non-pyrotechnic flare method may also include providing at least a portion of the wing-shaped appendage 104 with a reflective material 120.

In at least one embodiment that is configured to deter wildlife, the emitting (502) includes emitting the light at an ultraviolet (UV) wavelength at 100 cycles per minute.

In at least one embodiment, the non-pyrotechnic flare method also includes moving the wing-shaped appendage 104 between a stowed position 104*a*, in which the wing-shaped appendage 104 is coiled around the head 102, and an extended deployed position 104*b*, and powering the LED 108 by the moving.

As described herein, embodiments of the present disclosure provide non-pyrotechnic flare systems that are safer to use than traditional flares. The non-pyrotechnic flare systems are not susceptible to igniting structures or objects upon contact therewith.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A non-pyrotechnic flare system, comprising:

at least one flare member that is configured to be deployed, the at least one flare member comprising:

a head having a light-emitting diode (LED) that is configured to emit light when activated; and a wing-shaped appendage extending from the head, wherein the wing-shaped appendage is configured to control a descent of the at least one flare member.

2. The non-pyrotechnic flare system of claim 1, further comprising a casing that retains the at least one flare member in a stowed position, wherein the at least one flare member is configured to be deployed from the casing.

3. The non-pyrotechnic flare system of claim 2, wherein the at least one flare member comprises a plurality of flare members.

4. The non-pyrotechnic flare system of claim 2, further comprising a charging circuit coupled to one or both of the casing or the LED.

5. The non-pyrotechnic flare system of claim 1, wherein the wing-shaped appendage comprises:

a root that radially extends from the head, wherein the root includes an interior cuff;

an intermediate beam connected to the interior cuff;

an expanded distal end connected to the intermediate beam.

6. The non-pyrotechnic flare system of claim 1, wherein the wing-shaped appendage is aerodynamically shaped to allow the at least one flare member to rotate and descend towards ground at a controlled speed when the at least one flare member is deployed.

7. The non-pyrotechnic flare system of claim 1, wherein the at least one flare member is formed of one or more biodegradable materials.

8. The non-pyrotechnic flare system of claim 1, wherein at least a portion of the wing-shaped appendage includes a reflective material that is configured to reflectively disperse light emitted by the LED.

9. The non-pyrotechnic flare system of claim 1, wherein the LED is configured to emit the light at an ultraviolet (UV) wavelength at 100 cycles per minute.

10. The non-pyrotechnic flare system of claim 1, wherein the wing-shaped appendage is moveable between a stowed position, in which the wing-shaped appendage is coiled around the head, and an extended deployed position.

11. The non-pyrotechnic flare system of claim 10, wherein the wing-shaped appendage is formed of a piezoelectric material, and wherein the LED is powered by the wing-shaped appendance moving from the stowed position to the extended deployed position.

12. A non-pyrotechnic flare method, comprising:

deploying at least one flare member;

emitting light, during the deploying, from a light-emitting diode (LED) of a head; and controlling a descent of the at least one flare member, during the deploying, with a wing-shaped appendage extending from the head.

13. The non-pyrotechnic flare method of claim 12, further retaining the at least one flare member in a stowed position within a casing, wherein the deploying comprises deploying the at least one flare member from the casing.

14. The non-pyrotechnic flare method of claim 13, wherein the deploying comprises deploying a plurality of flare members.

15. The non-pyrotechnic flare method of claim 13, further comprising coupling a charging circuit to one or both of the casing or the LED.

16. The non-pyrotechnic flare method of claim 12, further comprising shaping the wing-shaped appendage to allow the at least one flare member to rotate and descend towards ground at a controlled speed during the deploying.

17. The non-pyrotechnic flare method of claim 12, further comprising forming the at least one flare member from one or more biodegradable materials.

18. The non-pyrotechnic flare method of claim 12, further comprising providing at least a portion of the wing-shaped appendage with a reflective material that is configured to reflectively disperse light emitted by the LED.

19. The non-pyrotechnic flare method of claim 12, wherein the emitting comprises emitting the light at an ultraviolet (UV) wavelength at 100 cycles per minute.

20. The non-pyrotechnic flare method of claim 12, further comprising:

moving the wing-shaped appendage between a stowed position, in which the wing-shaped appendage is coiled around the head, and an extended deployed position; and powering the LED by the moving.

* * * * *